United States Patent [19]

Oliff et al.

[11] 4,328,893

[45] May 11, 1982

[54] BOTTLE CARRIER

[75] Inventors: James R. Oliff, Austell; Prentice J. Wood, Hapeville, both of Ga.

[73] Assignee: The Mead Corporation, Dayton, Ohio

[21] Appl. No.: 197,375

[22] Filed: Oct. 15, 1980

[51] Int. Cl.[3] ..... B65D 5/02

[52] U.S. Cl. ..... 206/435; 206/140; 229/40

[58] Field of Search ..... 206/435, 145, 147, 148, 206/161, 175, 193, 197, 140; 229/40, 39 R

[56] References Cited

U.S. PATENT DOCUMENTS

| | | | |
|---|---|---|---|
| 2,172,090 | 9/1939 | Powell | 206/140 |
| 3,306,519 | 2/1967 | Wood | 229/40 |
| 3,348,671 | 10/1967 | Wood | 206/140 |
| 3,373,867 | 3/1968 | Wood | 206/140 |
| 4,022,372 | 5/1977 | Graser | 229/40 |
| 4,101,069 | 7/1978 | Wood | 229/40 |
| 4,202,446 | 5/1980 | Sutherland | 229/40 X |

*Primary Examiner*—Steven M. Pollard
*Attorney, Agent, or Firm*—Erwin Doerr

[57] ABSTRACT

A bottle carrier which comprises a tubular sleeve having top, bottom and spaced sidewalls and end closure panels hinged to the sidewalls at each end of the carrier. The end closure panels are closed by overlapping one with the other and are maintained closed by interengaging tabs formed along the inner edges of the panels. The tabs on the outermost end panel engages behind an oblique locking edge formed on the innermost end panel and relative movement between the locking tab and locking edge is limited by the tab formed on the innermost end panel.

4 Claims, 4 Drawing Figures

BOTTLE CARRIER

This invention relates to a bottle carrier and more particularly to end closure means for a wrap-around type bottle carrier.

Open ended wrap-around carriers for packaging groups of primary packages such as chimed cans and capped bottles constitute an economical and satisfactory packaging arrangement for many products. Where light protection is a consideration insofar as the packaged items are concerned and where the packages are to be shipped over substantial distances, it is known to provide closure means for the open ends such as end closure panels hinged to the end edges of the sidewalls. It is, of course, important that such end closure means are secured as by mutual engagement.

Examples of such known bottle carriers are disclosed in U.S. Pat. to Wood Nos. 3,306,519; 3,373,867; and 3,348,671. The end closure arrangements shown therein include end panels which are secured together by locking means in the form of a locking tab projecting from the outer, overlapping end panel approximately halfway between the top and bottom of the package, and an aligned slit provided in the other, underlying end panel and adapted to receive and retain the locking tab when the package is completed. The disadvantage of this arrangement, however, is that it requires a fairly complicated locking operation and that the lock itself may accidentally become disengaged when the package is handled without care.

One aspect of the invention provides a carrier for packaging two rows of bottles whose axes are disposed in substantial parallel relationship to one another, said carrier comprising a top panel, a pair of sidewall panels, and a pair of bottom panels hinged together to form a tubular structure in close contact with the bottles, a medial keel panel hinged to one of said bottom panels and disposed between the two rows of bottles, and a pair of end closure panels hinged to the end edges of respective sidewall panels at at least one end of the carrier, said end closure panels having adjacent inner edges overlapped one behind the other when closed and including interengaging means for locking the end closure panels together, said interengaging means being provided by parts of said inner edges located adjacent the medial keel at which parts the overlapped relationship of said inner edges is reversed with respect to the remaining mutually overlapped areas of the end closure panels, and a fastening notch formed in said medial keel for cooperating with said interengaging means to aid in holding said end closure panels closed.

Another aspect of the invention is in that each end closure panel includes an integral tab formed along said inner edge of the panel adjacent the lower edge thereof effective to maintain the closure panels in closed condition, the tab on the outermost end closure panel being engaged behind an oblique locking edge formed by a portion of the inner edge of the innermost end closure panel and having relative upward movement with respect to the locking edge limited by the tab formed on the innermost end closure panel, said movement limiting tab being formed immediately above the oblique locking edge and being located behind the outermost end closure panel.

Yet another aspect of the invention provides an elongate blank for forming a wrap-around carrier for accommodating two rows of bottles, which blank comprises a top wall panel, a pair of sidewall panels hinged respectively to opposed transverse edges of said top wall panel, and a pair of bottom wall panels hinged respectively to said sidewall panels and an end closure panel hinged along each longitudinal edge of each sidewall panel, and wherein each end closure panel includes an integral tab projecting outwardly from the free longitudinal edge thereof, the adjacent end closure panels along one side of the blank having their tabs positioned such that the tab on one of said adjacent panels is arranged to cooperate with an oblique locking edge formed along said free longitudinal edge of the other adjacent panel in closely spaced relationship with respect to the tab on said other adjacent panel.

For a better understanding of the invention, reference is made to the following detailed description taken in conjunction with the accompanying drawings, in which.

Figure 1:
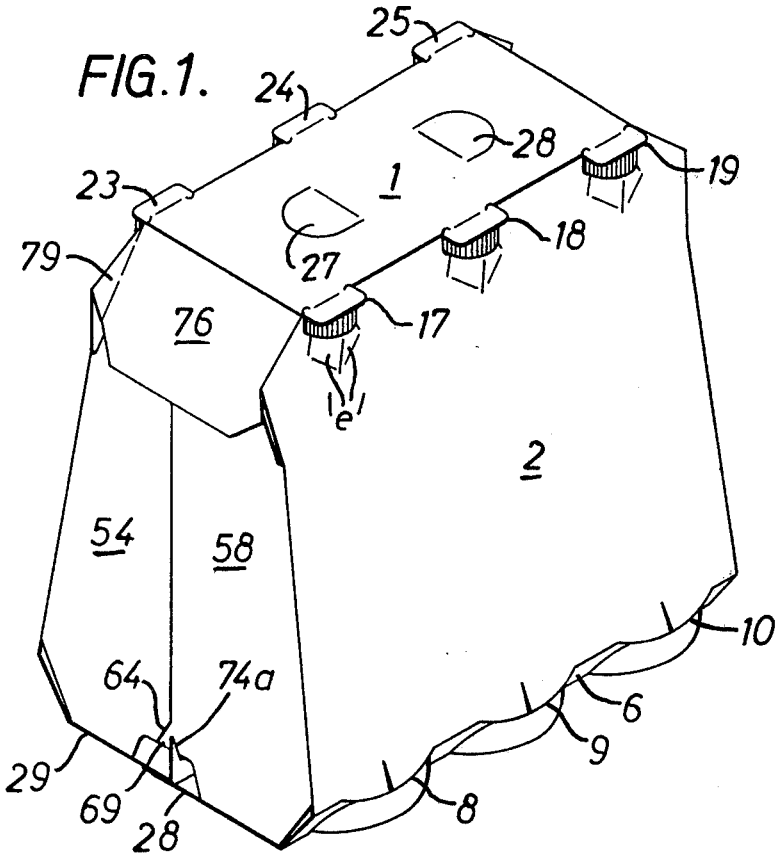
FIG. 1 is a perspective view of a wrap-around type carrier to which this invention is applicable and which shows end closure means constructed according to this invention.

Referring to the drawings, the numeral 1 generally designates the top panel of the wrapper to which a pair of sidewalls 2, 3 are hinged along transverse fold lines 4, 5 respectively. Bottom sloping panels 6 and 7 foldably are joined to the bottom edges of sidewall panels 2, 3 respectively. Formed in bottom sloping panel 6 are bottle receiving openings 8, 9 and 10. As is well known the bottom portion of the bottles 'B' protrude through the openings 8, 9 and 10 which serve to retain the bottles spaced apart within the carrier to avoid glass to glass contact. In a similar manner openings 11, 12 and 13 are formed in the bottom sloping panel 7 and have a corresponding function to that of the openings 8, 9 and 10.

To hold the tops of the bottles 'B' in place within the carrier a series of elongate slots 14, 15 and 16 are struck from the sidewall panel 2 along the fold line 4 adjacent top wall 1. The material dislodged in producing the slots 14, 15 and 16 is left hinged to the top wall panel 1 to provide tabs 17, 18 and 19 respectively which overlie the tops of the bottles when the tops of bottles packaged in the wrapper are received in the slots 14, 15 and 16. A series of scored lines are associated with the lowermost edge of each slot 14, 15 and 16, and provide in each case a pair of hinged cap engaging elements designated "e" in FIGS. 1 and 4 and which are arranged to engage the caps of the packaged bottles from underneath. Similar elongate slots 20, 21 and 22 and associated tabs 23, 24 and 25 are provided in the opposite side-wall panel 3. In this way, the top wall panel 1 is securely anchored to the packaged bottles. Also formed in the top panel is a pair of finger gripping apertures defined by hinged tabs 27, 28 respectively by which the carrier can be lifted and carried.

For forming the bottom of the carrier, a pair of bottom panels 28, 29 are hinged respectively to the bottom sloping panels 6 and 7 along the transverse fold lines 30 and 31.

In order to tighten the wrapper about a group of bottles to be packaged, a series of tightening apertures 32, 33 and 34 are struck from the bottom panel 28 and a series of similar tightening apertures 35, 36 and 37 are struck from the bottom panel 29. As is well understood in the art, suitable machine elements enter the tightening apertures 32, 33 and 34 and move underneath the group of articles towards the bottom panel 29. Similar machine elements enter the tightening apertures 35, 36 and 37 and draw the panel 30 towards the bottom panel 28. After the wrapper is suitable tightened the locking tabs 38 to 41 formed in the bottom panel 28 are driven through the locking openings defined by the retaining tabs 42 to 45 formed in the bottom panel 29. Of course, the bottom panels 28 and 29 are then arranged in overlapping relationship with the panel 29 disposed on the inside.

Figure 3:
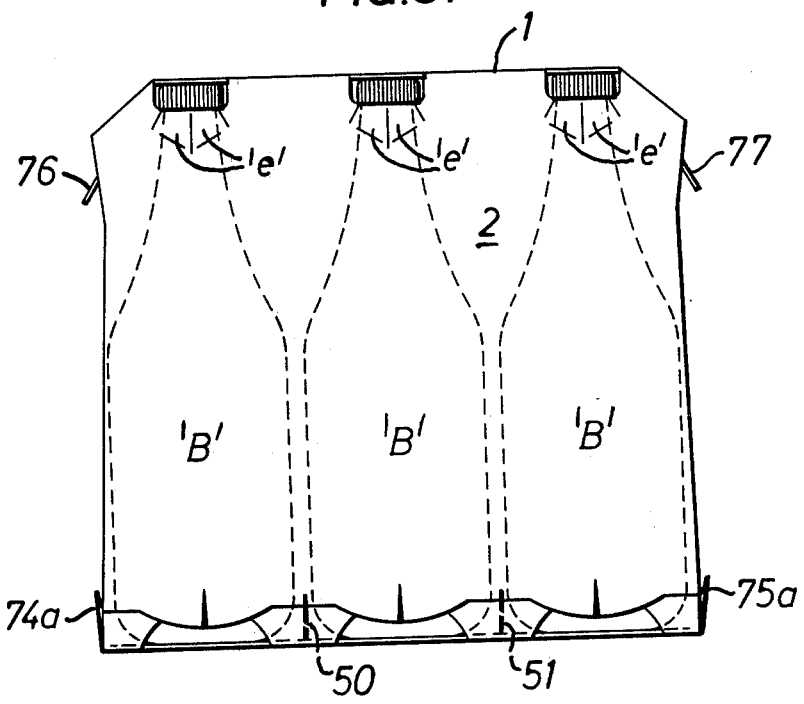
FIG. 3 is a side of the carrier shown in FIG. 1.

For separating the end bottles on one side of the wrapper from the middle bottles, a pair of tabs 46 and 47 are struck from the bottom panel 28 and foldably joined thereto along their respective fold lines 48, 49. In a similar manner, tabs 50 and 51 are struck from bottom panel 29 and are foldably joined thereto along fold lines 52 and 53, respectively. Tabs 46 and 47 as well as the tabs 50 and 51 are folded into position generally normal to the bottom panels 28 and 29 as is shown for example in FIG. 3 of the drawings.

For the purpose of forming a closure for the ends of the carrier, a pair of main (inner) end closure panels 54 and 55 are hinged along fold lines 56 and 57 respectively to the ends of sidewall panel 3. Similarly, a pair of secondary (outer) closure panels 58 and 59 are hinged along fold lines 60 and 61 respectively to the end edges of sidewall panel 2.

In order to describe the end closure arrangement in detail, the specific construction of and interaction between inner end closure panel 54 and outer end closure panel 58 will now be described, it being understood that a similar relationship exists between the inner panel 55 and outer panel 59 at the opposite end of the carrier.

Figure 2:
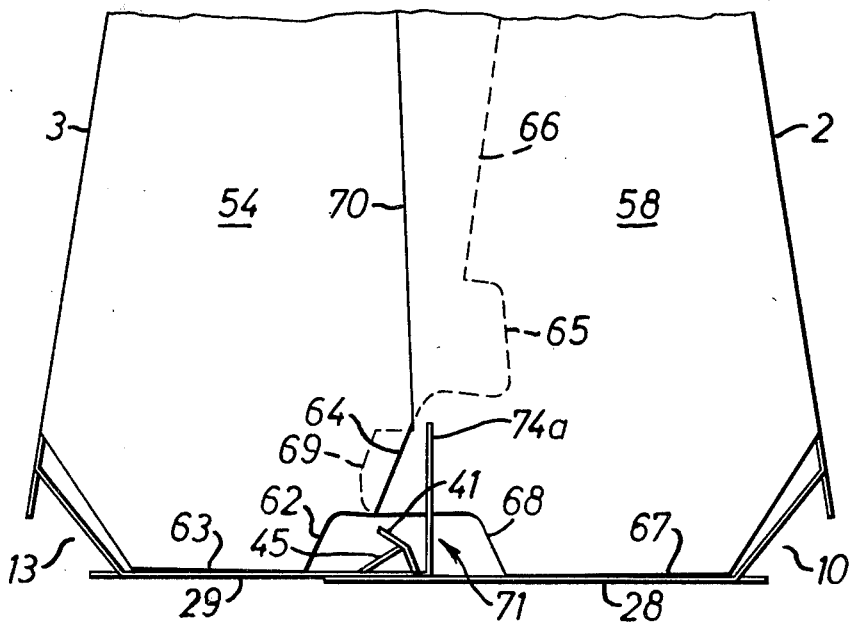
FIG. 2 is a detailed end view of one end closure of the carrier.

Referring to FIG. 2 of the drawings, the inner edge of innermost end closure panel 54 is formed to provide a stepped portion 62 adjacent the lower edge 63 of the panel, a locking edge 64 extending obliquely upwardly, terminating in a protruding integral tab 65 and the remaining overlapped zone 66 of the inner edge extending obliquely upwardly. The angles with which the edges of the panel 54 at the locking edge 64 and the overlapped zone 66 make with respect to the vertical are different. It will be noted that with respect to the vertical, the angle of the edge at overlapped zone 66 is more acute than that at the edge of locking zone 64. In the particular construction shown the edge of the locking zone 64 may be notionally extended to bisect the top outermost corner of the tab 65.

The outermost end panel 58 also comprises a stepped portion 68 adjacent the lower edge 67 of the panel, which is continued to provide a projecting integral locking tab 69. The remaining innermost edge 70 of the panel 58 extends vertically upwardly with respect to the bottom panels from the locking tab 69. The panel 58 is of smaller overall area than the innermost end panel 54.

For closing the end of the wrapper the two end closure panels 54 and 58 are sequentially folded inwardly and overlapped such that the inner edge of the panel 54 underlies the inner edge of panel 58 whereby the locking tab 65 is located inwardly of the carrier. Locking tab 69 locates behind the oblique locking edge 64 of panel 54 such that the two stepped zones 62, 68 are brought into register to form a recess 71. It will be noted that the tab 65 limits upward movement of the locking tab 69 with respect to the oblique locking edge 64, which is of particular advantage in minimizing the effects of "racking" when the package is handled. As a result of this, the overlapped relationship between the end closure panels 54 and 58 is reversed at the locking tab 69, since tab 69 is disposed inwardly of the carrier whereas the remaining inner edge of panel 58 is disposed outwardly of the carrier. It will be appreciated that the inner inclined edge zone 66 of panel 54 allows a considerable amount of material of panel 54 to be overlapped beneath the panel 58 which makes for a secure closure at the ends of the wrapper.

In order to aid in holding the end closure panels in their closed condition and in engagement with the adjacent end bottles, a pair of locking notches are formed in a medial keel panel designated by the numeral 72 and hinged along fold line 73 to one edge of the bottom panel 29. The notches are designated at 74 and 75 respectively. As is understood in the art, the keel panel 72 normally is disposed in perpendicular relationship to the bottom panels 28 and 29, as is best shown in FIGS. 1 and 2, so as to minimize glass to glass contact between the two rows of bottles.

As will be understood best from FIG. 2 of the drawings, the recess 71 formed by stepped portions 62, 68 of panels 54, 58, respectively, will be located within the notch 74 of keel panel 72 such that the finger 74*a* formed at the extremity of the keel 72 will be located outwardly of the interengaged locking tab 69 and oblique locking edge 64. Of course, this arrangement limits outward movement of tab 69 and edge 64 and thus aids in holding both panels 54 and 58 securely closed. Likewise, end closure panels 55 and 59 are held in the closed position by locking notch 75 at the other end of the medial keel panel 72.

Figure 4:
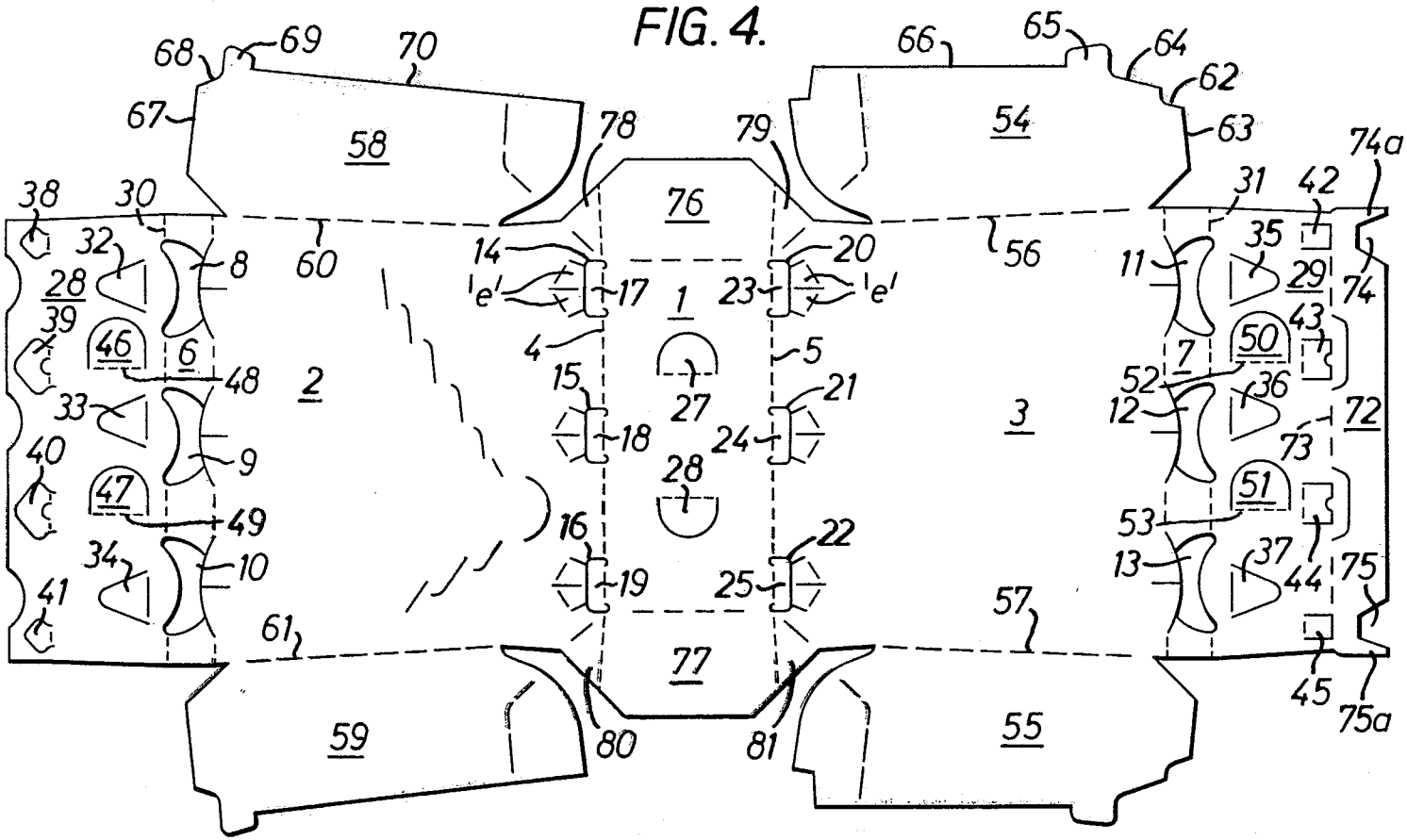
FIG. 4 is a plan view of a blank from which the carrier shown in FIGS. 1 to 3 inclusive is formed.

As will be appreciated from FIGS. 1 and 4 of the drawings, the end closure panels 54, 58 and 55, 59 do not extend the whole height of the carrier and a pair of end flaps 76 and 77 are hinged at opposite ends of top panel 1 and folded downwardly into overlapping relationship with the top portions of the end closure panels. The end flaps 76 and 77 are disposed at an obtuse angle with respect to top panel 1 and held in that position by gusset panel pairs 78, 79 and 80, 81, respectively. The gusset panels 78, 79 are foldably joined to the side edges of the end flap 76 and to the adjacent ends of the sidewall panels 2 and 3, respectively. Similarly, the gusset panels 80, 81 are foldably joined to the side edges of the end flap 76 and to the adjacent ends of the sidewall panels 2 and 3, respectively. If desired, the end flaps may be secured to the upper portions of the end closure panels, for instance by a suitable adhesive to be applied as the package is formed.

From the above description, it will be understood that this invention provides an improved interlocking arrangement for the end closure panels 54, 58 and 55, 59, respectively. In particular, the specific construction of and interrelationship between the cooperating pairs of end closure panels is such that the risk that the end closure panels would accidentally become disengaged when the package is being handled, particularly "racked" in the transverse direction, is minimized.

What I claim is:

1. A wrap-around carrier for packaging bottles arranged in two adjacent parallel rows, said carrier comprising a top panel, a pair of side wall panels, and a pair of bottom panels hinged together to form a tubular structure in close contact with the bottles, a medial keel panel hinged to one of said bottom panels and disposed between the two rows of bottles, and a pair of end closure panels hinged to the end edges of respective side wall panels at at least one end of the carrier, said end closure panels having adjacent inner edges overlapped one behind the other when closed and including interengaging means for locking the end closure panels together, said interengaging means being provided by portions of said inner edges located adjacent the medial keel and overlapped in a reverse order as compared to the remaining mutually overlapped areas of the end closure panels, and a locking notch formed in said medial keel for cooperating with said interengaging means to aid in holding said end closure panels closed, said interengaging means comprising an integral tab formed on the outer end closure panel and a locking zone formed by an oblique edge part of the inner end closure panel with said tab located behind said oblique locking edge, and means for limiting relative sliding movement of said tab upwardly with respect to the oblique locking edge including an integral tab formed on the inner end closure panel immediately above said oblique locking edge and located behind the outer end closure panel, the inner edge of said inner end closure panel above said movement limiting tab being upwardly inclined such that the overlapped area of said inner end closure panel increases in a direction towards the top panel of the carrier.

2. A carrier according to claim 1 in which said locking notch is defined in part by an upstanding finger located outwardly of said interengaged tab and oblique locking edge so as to limit outward displacement thereof.

3. A carrier for packaging bottles arranged in two adjacent parallel rows, said carrier comprising a top wall, a pair of side wall panels, and a bottom wall hinged together to form a tubular structure in close contact with the bottles, and a pair of end closure panels hinged to the end edges of respective side wall panels at at least one end of the carrier, said end closure panels having adjacent inner edges overlapped one behind the other when closed and including interengaging means for locking the end closure panels together, said interengaging means being provided by portions of said inner edges located adjacent the bottom wall, which portions are overlapped in a reverse order as compared to the remaining mutually overlapped areas of the end closure panels, said interengaging means comprising an integral tab formed on the outer end closure panel and a locking zone formed by an oblique edge part of the inner end closure panel with said tab located behind said oblique locking edge, and an integral tab formed on the inner end closure panel immediately above said oblique locking edge and located behind the outer end closure panel whereby relative upward movement of said end closure panels is restrained.

4. A carrier according to claim 3 in which said bottom wall is formed from a pair of bottom panels and a medial keel panel is hinged to one of said botton panels and disposed between the two rows of bottles, said medial keel panel including a locking notch for receiving the outer end closure panel tab when engaged with said oblique locking edge to aid in holding said end closure panels closed.

* * * * *